US012163725B2

(12) United States Patent
Ma et al.

(10) Patent No.: US 12,163,725 B2
(45) Date of Patent: Dec. 10, 2024

(54) WATER STORAGE BOX AND REFRIGERATOR

(71) Applicants: QINGDAO HAIER REFRIGERATOR CO., LTD., Qingdao (CN); HAIER SMART HOME CO., LTD., Qingdao (CN)

(72) Inventors: Mingming Ma, Qingdao (CN); Weijian Fu, Qingdao (CN); Wenlong Liu, Qingdao (CN)

(73) Assignees: QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 111 days.

(21) Appl. No.: 17/921,972

(22) PCT Filed: Dec. 18, 2020

(86) PCT No.: PCT/CN2020/137540
§ 371 (c)(1),
(2) Date: Oct. 27, 2022

(87) PCT Pub. No.: WO2021/218193
PCT Pub. Date: Nov. 4, 2021

(65) Prior Publication Data

US 2023/0175763 A1 Jun. 8, 2023

(30) Foreign Application Priority Data

Apr. 30, 2020 (CN) ..... 202010366132.1

(51) Int. Cl.
*F25D 23/06* (2006.01)
*F25C 1/25* (2018.01)
(Continued)

(52) U.S. Cl.
CPC ..... *F25D 23/061* (2013.01); *F25C 1/25* (2018.01); *F25D 23/126* (2013.01);
(Continued)

(58) Field of Classification Search
CPC ..... F25C 2400/14; F25C 1/24; F25C 1/25; F25D 23/126; F25D 23/061; F25D 2323/122; F25D 25/005; F25D 25/025
See application file for complete search history.

(56) References Cited

U.S. PATENT DOCUMENTS 5,458,412 A * 10/1995 Lee ..... E05D 3/022 49/260
7,467,834 B2 * 12/2008 Kim ..... F25D 25/025 312/402
(Continued)

FOREIGN PATENT DOCUMENTS

CN 1975297 A 6/2007
CN 102022886 A 4/2011
(Continued)

*Primary Examiner* — Andrew Roersma
(74) *Attorney, Agent, or Firm* — Cheng-Ju Chiang

(57) ABSTRACT

A water storage box and a refrigerator; the water storage box includes a box body and a front panel provided on a front end surface of the box body, and further includes: a locking structure including a locking part and a fitting part, one of the locking part and the fitting part being provided on a rear surface of the front panel, the other of the locking part and the fitting part being provided on the front end surface, and the locking structure being provided near a first side of the front end surface; at least one overturning structure provided between the rear surface and the front end surface, the at least one overturning structure being provided close to a second side of the front end surface, and the first side being opposite to the second side.

14 Claims, 11 Drawing Sheets

(51) Int. Cl.
*F25D 23/12* (2006.01)
*F25D 25/02* (2006.01)

(52) U.S. Cl.
CPC ..... *F25D 25/025* (2013.01); *F25C 2400/14* (2013.01); *F25D 2323/122* (2013.01)

(56) References Cited

U.S. PATENT DOCUMENTS

| | | | | |
|---|---|---|---|---|
| 8,955,352 | B2 * | 2/2015 | Lee | F25D 23/02 312/273 |
| 10,006,693 | B2 * | 6/2018 | Ramm | F25D 25/025 |
| 10,712,082 | B1 * | 7/2020 | Nuss | E05D 11/1007 |
| 10,753,673 | B2 * | 8/2020 | Sert | F25C 1/25 |
| 2010/0090575 | A1 * | 4/2010 | Uthuppan | F25D 23/04 312/404 |
| 2015/0374125 | A1 * | 12/2015 | Goetz | A47B 88/49 312/319.1 |

FOREIGN PATENT DOCUMENTS

| | | | | | |
|---|---|---|---|---|---|
| CN | 102359308 | A | | 2/2012 | |
| CN | 205957591 | U | | 2/2017 | |
| CN | 106568289 | A | | 4/2017 | |
| CN | 107036380 | A | | 8/2017 | |
| CN | 108204708 | A | * | 6/2018 | A47B 88/00 |
| CN | 108955029 | A | * | 12/2018 | F25D 11/02 |
| EP | 2778584 | A2 | | 9/2014 | |
| JP | 2009036452 | A | * | 2/2009 | F25D 23/021 |
| JP | 2019-49399 | A | | 3/2019 | |
| KR | 10-2010-0009095 | A | | 1/2010 | |

* cited by examiner

200

WATER STORAGE BOX AND REFRIGERATOR

CROSS REFERENCE TO RELATED APPLICATIONS

The present invention is a 35 U.S.C. § 371 National Phase conversion of International (PCT) Patent Application No. PCT/CN2020/137540, filed on Dec. 18, 2020, which claims benefit of Chinese Application No. 202010366132.1, filed on Apr. 30, 2020, the disclosure of which is incorporated by reference herein. The PCT International Patent Application was filed and published in Chinese.

TECHNICAL FIELD

The present invention relates to the field of household appliances, and in particular, to a water storage box and a refrigerator having the same.

BACKGROUND

Currently, in an intelligent refrigerator with an automatic ice making function, a water storage box for supplying liquid water to an ice maker is often required to be provided in a refrigerating chamber of the refrigerator. The water storage box is mostly configured as a water box of a slide-rail-free handle type structure.

For the water box of a slide-rail-free handle type structure, a handle position may occupy partial space in the refrigerating chamber to cause space waste, thus affecting an overall appearance and an experience effect of the refrigerator.

SUMMARY

An object of the present invention is to provide a hidden water storage box structure which may overcome an influence of a water storage box with a handle type structure on space and an appearance of a refrigerator and meanwhile avoid limitation on a placement position of the refrigerator and water path pollution caused by an external water taking structure.

In order to achieve one of the above-mentioned objects, an embodiment of the present invention provides a water storage box accommodated in a compartment of a refrigerator, the water storage box including a box body and a front panel provided on a front end surface of the box body, and further including: a locking structure including a locking part and a fitting part, one of the locking part and the fitting part being provided on a rear surface of the front panel, the other of the locking part and the fitting part being provided on the front end surface, and the locking structure being provided near a first side of the front end surface; at least one overturning structure provided between the rear surface and the front end surface, the at least one overturning structure being provided close to a second side of the front end surface, and the first side being opposite to the second side; wherein in a state where the locking part and the fitting part are separated, the overturning structure drives the locking part to move away from the fitting part, or the overturning structure drives the fitting part to move away from the locking part.

As an optional technical solution, the locking part and the fitting part have structures locked and unlocked by a pressing operation.

As an optional technical solution, the water storage box is provided in a mounting cavity in the compartment of the refrigerator, the front panel is flush with a front end opening of the mounting cavity, and the front panel extends out of the front end opening after turned over.

As an optional technical solution, a pushing-ejecting slide rail is provided between a bottom of the box body and a lower shelf of the mounting cavity; a partition is provided in the mounting cavity, the partition is adjacent to a side wall of the box body of the water storage box, a first sliding guide is provided on the partition, a second sliding guide is provided on the side wall, the second sliding guide is lapped on the first sliding guide, and the second sliding guide may slide along the first sliding guide.

As an optional technical solution, the first sliding guide is configured as a first wedge-shaped block protruding from the partition, and the second sliding guide is configured as a second wedge-shaped block protruding from the side wall; an inclined surface of the second wedge-shaped block is lapped on an inclined surface of the first wedge-shaped block, and the inclined surface of the second wedge-shaped block may slide in a front-back direction of the first sliding guide along the inclined surface of the first wedge-shaped block.

As an optional technical solution, the overturning structure includes a rotating shaft, a rotating part and an elastic part, and the rotating shaft is provided on the rear surface; the rotating part includes a rotating shaft hole, and the rotating shaft is accommodated in the rotating shaft hole; the rotating part is sleeved with the elastic part, a fixed end of the elastic part is incorporated in the rotating part, and a free end of the elastic part elastically pushes against the front end surface.

As an optional technical solution, a bump is provided on the front end surface, the free end is sleeved with a depression of the bump, and the free end may elastically push against the front end surface; a notch is provided in the rotating part, and the fixed end of the elastic part is fixed in the notch.

As an optional technical solution, a fixing sheet extends from the front end surface, a through hole is provided in the fixing sheet, and the elastic part and the rotating part are inserted into the through hole; a decorative strip is provided in a gap between the front end surface and the front panel, a locking hole is provided in the decorative strip, a screw penetrates through the locking hole and is locked in the rotating shaft hole, and then, the decorative strip, the rotating part and the front panel are fixedly connected with one another.

As an optional technical solution, a partition is provided in the mounting cavity in the compartment of the refrigerator, and a cantilever portion protrudes from an inner side of the partition; a groove is provided in a lateral side of an upper cover of the water storage box; the cantilever portion is snapped into the groove.

The present invention further provides a refrigerator, in which a water storage box according to any one of the above descriptions is mounted.

Compared with a prior art, the front end surface of the box body of the water storage box is provided with the front panel which may be turned over, and the front panel is pressed to be turned over, such that a user may grasp the front panel conveniently, and a handle of the existing handle type water storage box is replaced, thus solving a problem that the handle type water storage box occupies large space in the refrigerator.

DETAILED DESCRIPTION

Hereinafter, the present invention will be described in detail in conjunction with specific embodiments shown in the accompanying drawings. However, these embodiments have no limitations on the present invention, and any transformations of structure, method, or function made by persons skilled in the art according to these embodiments fall within the protection scope of the present invention.

Figure 1:
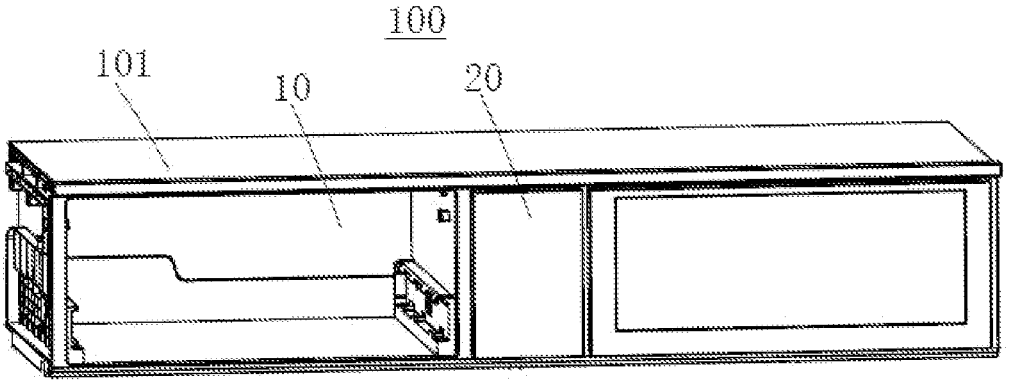
FIG. 1 is a schematic diagram of a mounting cavity in a refrigerator having an ice-making water storage box according to the present invention.
Figure 2:
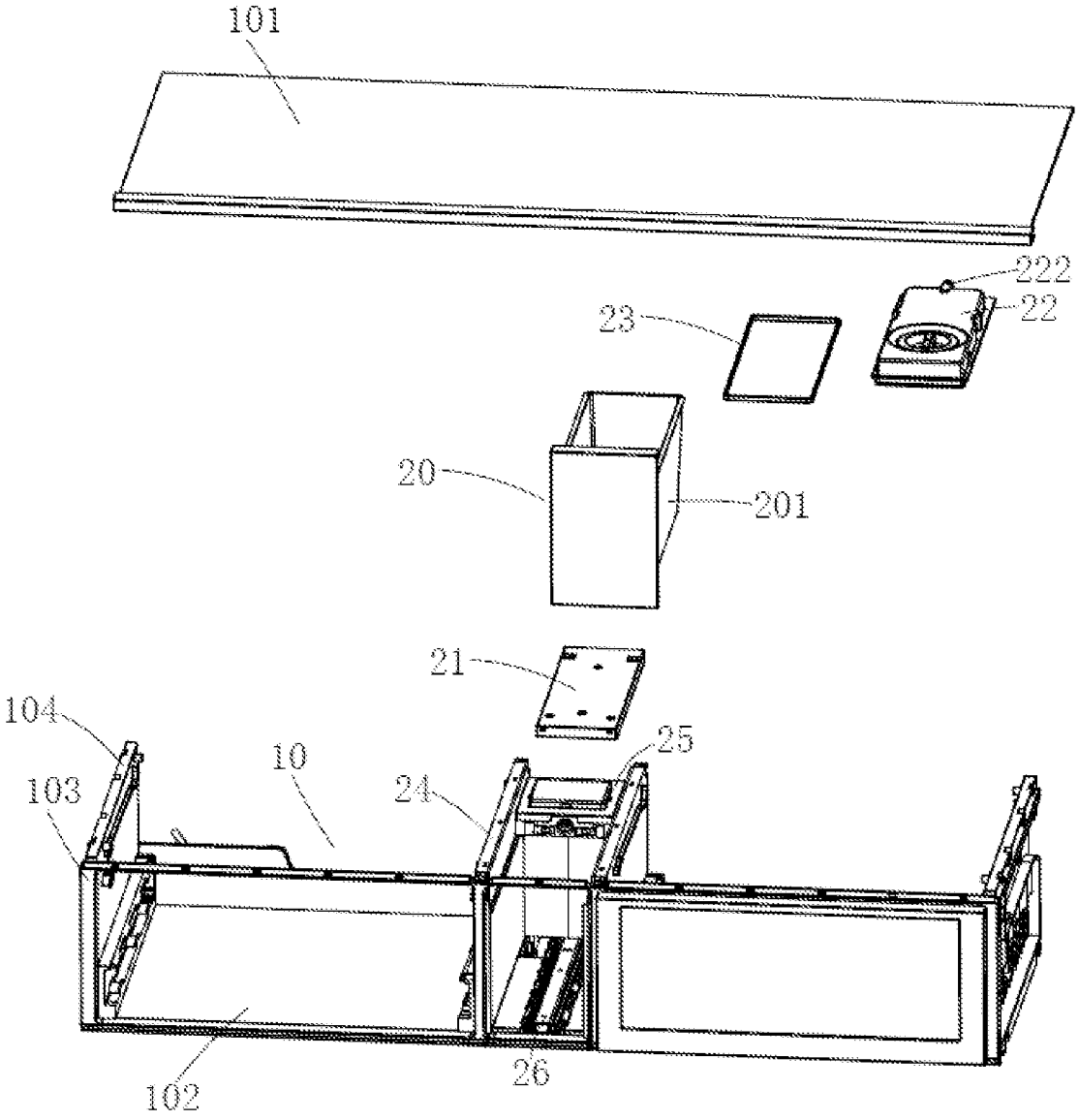
FIG. 2 is a schematic exploded diagram of some elements of FIG. 1.

As shown in FIGS. 1 and 2, a mounting cavity 100 is mounted in a refrigerating chamber in a cabinet of a refrigerator (not shown), a water storage box 20 for an ice making device is mounted in the mounting cavity 100, and when the ice making device makes ice, a water pump assembly 25 pumps water in the water storage box 20 and delivers the water into a water box of the ice making device to make ice.

The mounting cavity 100 includes an upper shelf 101, a lower shelf 102 and opposite left and right side walls 104, the upper shelf 101 is opposite to the lower shelf 102, the upper shelf 101, the lower shelf 102 and the left and right side walls 104 define an accommodating portion 10 together, and the water storage box 20 is mounted in the accommodating portion 10. Front ends of the left and right side walls 104 are assembled to a frame 103.

In the present embodiment, the front ends of the left and right side walls 104 and a front wall of the water storage box 20 refer to ends of the left and right side walls 104 and the water storage box 20 close to a user respectively. Rear ends of the left and right side walls 104 refer to ends apart from the user, and are fixedly attached to a liner wall of the refrigerator.

In addition, a pair of partitions 24 are provided in the accommodating portion 10, the pair of partitions 24 partition the accommodating portion 10 into three chambers spaced apart from one other, and the water storage box 20 is mounted in one of the three chambers spaced apart from one other. In the present embodiment, the water storage box 20 is mounted in the middle chamber of the three chambers spaced apart from one other, and the water storage box 20 is located between the pair of partitions 24. The partition 24 has a heat preservation function, and may avoid that the water in the water storage box 20 is frozen due to an excessively low temperature of the refrigerating chamber, and thus, the water pump assembly 25 is unable to take water.

The water storage box 20 includes a box body 201 and an upper cover 22, the upper cover 22 covers the box body 201, a sealing gasket 23 is provided between the upper cover 22 and the box body 201, a lateral side of the upper cover 22 extending towards the box body 201 is sleeved with the sealing gasket 23, and when the upper cover 22 covers the box body 201, the sealing gasket 23 is sandwiched between the lateral side of the upper cover 22 and a side wall of the box body 201. The lateral side of the upper cover 22 is located inside the side wall of the box body 201.

A pushing-ejecting slide rail 26 is provided between a bottom of the box body 201 of the water storage box 20 and the lower shelf 102, and the pushing-ejecting slide rail 26 may eject the water storage box 20 from the mounting cavity 100 and lock the water storage box 20 in the mounting cavity 100.

Specifically, a movable rail of the pushing-ejecting slide rail 26 is provided at the bottom of the box body 201, and a fixed rail of the pushing-ejecting slide rail 26 is connected with the lower shelf 102; when the pushing-ejecting slide rail 26 is in a locked state, the front wall of the water storage box 20 is pressed, the pushing-ejecting slide rail 26 is unlocked, and the water storage box 20 is ejected from the mounting cavity 100; when in a sliding state, the pushing-ejecting slide rail 26 pushes against the front wall of the water storage box 20, the water storage box 20 is completely pushed into the mounting cavity 100, and the pushing-ejecting slide rail 26 returns to the locked state.

With the sliding ejecting function of the pushing-ejecting slide rail 26, the water storage box 20 may slide out of the mounting cavity 100 with the pushing-ejecting slide rail 26, such that the user may add water into the water storage box 20 conveniently; with the self-locking function of the pushing-ejecting slide rail 26, the water storage box 20 may slide into the mounting cavity 100 with the pushing-ejecting slide rail, and when the water storage box 20 is completely received in the mounting cavity 100, the pushing-ejecting slide rail may lock the water storage box 20 in the mounting cavity 100. The pushing-ejecting slide rail 26 is located between the bottom of the box body 201 and the lower shelf 102, and occupies small space, which may increase a utilization rate of space in the refrigerator, such that an overall appearance of the refrigerator is more attractive. In addition, the water storage box 20 may slide out and in by adopting the pushing-ejecting slide rail 26, and after a handle structure is omitted at the front end of the water storage box 20, the space occupied by the water storage box with a same volume in the refrigerator is reduced, thus avoiding waste of the space in the refrigerator.

In a preferred embodiment, the movable rail of the pushing-ejecting slide rail 26 is accommodated in a sliding groove of the fixed rail, an opening of a sliding groove of the movable rail is opposite to an opening of the sliding groove of the fixed rail, and the sliding grooves of the movable rail and the fixed rail are configured as C-shaped grooves respectively. The pushing-ejecting slide rail 26 is configured as, for example, a three-section bouncing C-shaped slide rail, but the present invention is not limited thereto. Any slide rail which may achieve a pressing bouncing function or a pulling pushing-ejecting function may be suitable for a slide between a mounting base and the lower shelf in the present invention.

It should be noted that, when the pushing-ejecting slide rail 26 with a C-shaped structure is mounted between the bottom of the water storage box 26 and the lower shelf, although small space is occupied, the water storage box 20 tends to slide unstably when the water storage box 20 is pressed to be ejected.

Further, a sliding guide structure is provided between the box body of the water storage box 20 and the partition 24 to solve the unstable problem caused when the water storage box 20 is driven by the C-shaped pushing-ejecting slide rail 20 to be ejected and slide.

Figure 3:
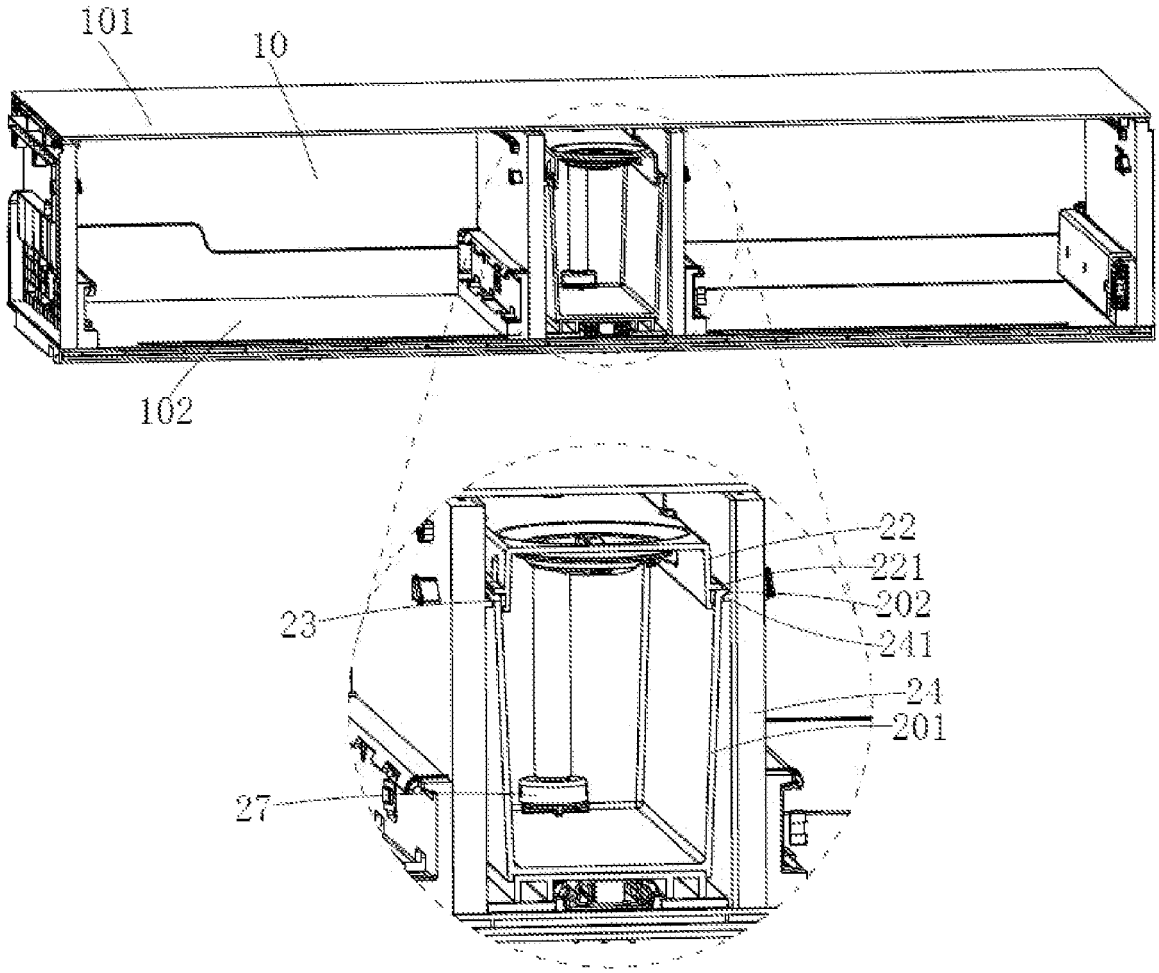
FIG. 3 is a schematic sectional diagram of FIG. 1 from a first perspective.

As shown in FIG. 3, a first sliding guide 241 is provided on an inner side of the partition 24, and a second sliding guide 202 is provided on the side wall of the box body 201; the second sliding guide 202 is lapped on the first sliding guide 241, and when the water storage box 20 slides, the second sliding guide 202 slides along the first sliding guide 241.

Preferably, the first sliding guide 241 is configured as a first wedge-shaped block protruding from the inner side of the partition 24, the second sliding guide 202 is configured as a second wedge-shaped block protruding from the side wall of the box body 201, an inclined surface of the second wedge-shaped block is lapped on an inclined surface of the first wedge-shaped block, and the inclined surface of the second wedge-shaped block may slide along the inclined surface of the first wedge-shaped block in a front-back direction of the first sliding guide 241 (the "front-back direction" corresponds to a sliding direction in which the water storage box 20 slides out of and into the mounting cavity 100).

Since the inclined surface of the first wedge-shaped block is lapped on the inclined surface of the second wedge-shaped block, when the water storage box 20 slides, a small frictional force exists between the water storage box 20 and the partition 24, the small frictional force may not block the slide of the water storage box 20, and better sliding smoothness is achieved on a premise of guaranteeing a stable slide.

In the present embodiment, the first sliding guides and the second sliding guides are provided between the inner sides of the left and right partitions 24 and the adjacent left and right side walls of the box body 201, but the present invention is not limited thereto. In other embodiments of the present invention, the first and second sliding guides may be provided only between the left partition and the left side wall or between the right partition and the right side wall.

In addition, the second wedge-shaped block may be regarded as a skirt structure extending from an upper edge of the side wall of the box body 201, the skirt structure is approximately perpendicular to the side wall, and the skirt structure is configured as a wedge-shaped structure. In other embodiments of the present invention, the second sliding guide may be provided at any position of the side wall of the box body according to an actual use requirement.

The above-mentioned skirt structure and the box body 201 are integrally formed, thus simplifying manufacturing steps of the second sliding guide 202.

As shown in FIGS. 2 and 3, the first sliding guide 241 is configured as, for example, a long-strip-shaped wedge-shaped block protruding from the inner side of the partition 24.

Figure 4:
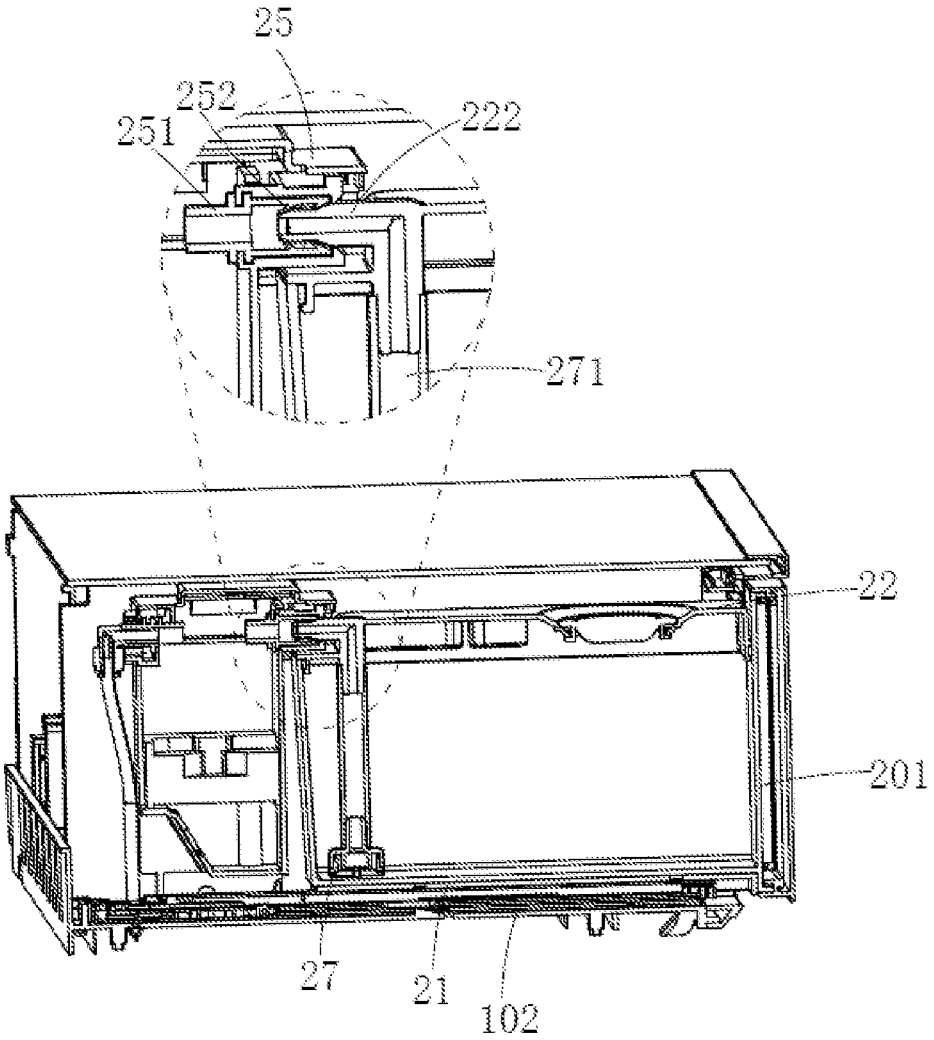
FIG. 4 is a schematic sectional diagram of FIG. 1 from a second perspective.

As shown in FIGS. 2, 3 and 4, when the upper cover 22 covers the box body 201, the sealing gasket 23 is sandwiched between the lateral side of the upper cover 22 and the side wall of the box body 201, and the sealing gasket 23 may provide a sealing performance for the water storage box 20, so as to prevent the water in the water storage box from overflowing and flowing into the refrigerator. Preferably, the sealing gasket 23 is configured as a silica-gel sealing gasket, for example.

In the present embodiment, the sealing gasket 23 is sleeved with a depression of a lower portion of the lateral side of the upper cover 22, the lower portion of the lateral side of the upper cover 22 is close to an upper portion of the side wall of the box body 201, and the lower portion of the lateral side of the upper cover 22 may be accommodated in the box body 201. In addition, the upper cover 22 is further provided with a stop portion 221, and the stop portion 221 is adjacent to a position above the depression to avoid that the sealing gasket 23 slides upwards and drops out from a position between the lower portion of the lateral side of the upper cover 22 and the upper portion of the side wall of the box body 201, resulting in a reduction of the sealing performance of the water storage box 20.

As shown in FIGS. 2, 3 and 4, the water pump assembly 25 is further provided between the pair of partitions 24, and the water pump assembly 25 is provided near a rear end of the mounting cavity 100 and adjacent to a rear wall of a liner of the refrigerator.

A rear end of the upper cover 22 is provided with a water outlet pipe 222, and a first end of the water outlet pipe 222 extends towards the water pump assembly 25 and may be inserted into a pipe cavity of a water pumping pipe 251 in the water pump assembly 25; a second end of the water outlet pipe 222 is bent at a lower surface (the lower surface faces a surface of the box body 201) of the upper cover 22 and extends into the box body 201.

A water purifying device 27 is also provided in the box body 201 and configured to purify the water in the water storage box 20. The water purifying device 27 is mounted at the bottom of the box body 201, and includes a filter cartridge, a top of the filter cartridge is communicated with a lower end of a connecting line 271, and an upper end of the connecting line 271 is connected with the second end of the water outlet pipe 222. In the present embodiment, the second end of the water outlet pipe 222 is inserted into a pipe cavity at the upper end of the connecting line 271.

The water pump assembly 25 is started, and the water accommodated in the box body 201 is filtered by the filter cartridge of the water purifying device 27, sequentially passes through the connecting line 271, the water outlet pipe 222 and the water pumping pipe 25, and is conveyed to an ice making bin of the ice making device through a water pipe pre-provided in the cabinet.

In the present embodiment, the water outlet pipe 222 at the rear end of the upper cover 22 is configured such that, as the water storage box 20 slides towards the mounting cavity, the first end of the water outlet pipe 222 is aligned with the water pumping pipe 251 and may be inserted into the pipe cavity of the water pumping pipe 251.

The water pump assembly 25 pumps the water purified by the water purifying device 27 and conveys the water to an ice making unit, which prevents the water from being polluted, such that the made ice is purer and safer.

In a preferred embodiment, the water outlet pipe 222 has an inverted L-shaped structure.

Furthermore, the water outlet pipe 222 is provided on the upper cover 22, such that as much water as possible is accommodated in the box body 201.

As shown in FIG. 4, the water storage box 20 is received in the mounting cavity 100, the water storage box 20 is maintained in the locked state by the pushing-ejecting slide rail 26, and at this point, the first end of the water outlet pipe 222 is inserted into the pipe cavity of the water pumping pipe 251.

A sealing ring 252 protrudes from an inner wall of the water pumping pipe 251 towards an interior of the pipe cavity, the sealing ring 252 is provided around the inner wall of the water pumping pipe 251, and an inner diameter of the sealing ring 252 is less than an outer diameter of the rear end of the water outlet pipe 222 in a natural state. The "natural state" refers to a state in which the sealing ring is not assembled at the first end of the water outlet pipe 222 and not deformed.

When the first end of the water outlet pipe 222 is inserted into the pipe cavity of the water pumping pipe 251, the sealing ring 252 is tightly fitted with the first end of the water outlet pipe 222, and the sealing ring 252 is tightly attached to an outer wall of the water outlet pipe 222. The tight fit refers to an interference fit; that is, after assembly of the first end of the water outlet pipe 222 and the sealing ring 252, the sealing ring 252 is elastically deformed to apply an elastic pressure to the first end of the water outlet pipe 222 and is tightly attached to the first end of the water outlet pipe 222.

The sealing ring 252 is tightly attached to the outer wall of the first end of the water outlet pipe 222, thus avoiding that water flowing out of the water outlet pipe 222 seeps and flows into the mounting cavity 100 from a gap between the inner wall of the pipe cavity of the water pumping pipe 252 and the outer wall of the first end of the water outlet pipe 222 before entering the water pumping pipe 251, resulting in water seepage in a refrigerating compartment of the refrigerator.

In addition, when the water pump assembly 25 malfunctions and water reversely flows into the water storage box 20 from the water pump assembly 25, the sealing ring 253 may also prevent a water seepage problem caused by the reverse flow of water.

In a preferred embodiment, the sealing ring 252 is configured as a silica-gel sealing ring.

In another preferred embodiment, a number of the sealing rings 252 is at least one; in the present embodiment, the number of the sealing rings 252 is two, and the two sealing rings 252 are provided on the inner wall of the pipe cavity of the water pumping pipe 251 at intervals and tightly attached to the outer wall of the first end of the water outlet pipe 222 inserted into the pipe cavity.

As shown in FIGS. 2 and 5 to 7, after the water storage box 20 is ejected from the mounting cavity 100, in order to facilitate the user to take down the whole water storage box 20, a mounting base 21 is provided between the bottom of the box body 201 of the water storage box 20 and the pushing-ejecting slide rail 26, the mounting base 21 is fixedly connected with the movable rail of the pushing-ejecting slide rail 26, and the mounting base 21 is detachably connected with the bottom of the box body 201.

Figure 5:
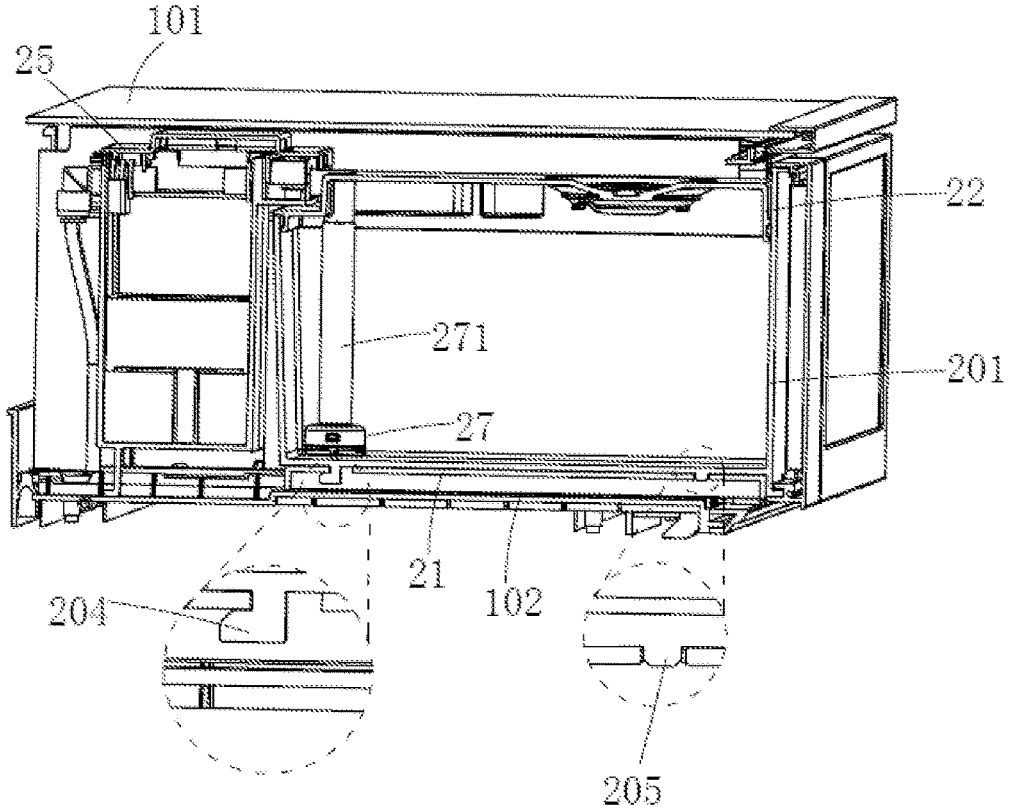
FIG. 5 is a schematic sectional diagram of FIG. 1 from a third perspective.
Figure 6:
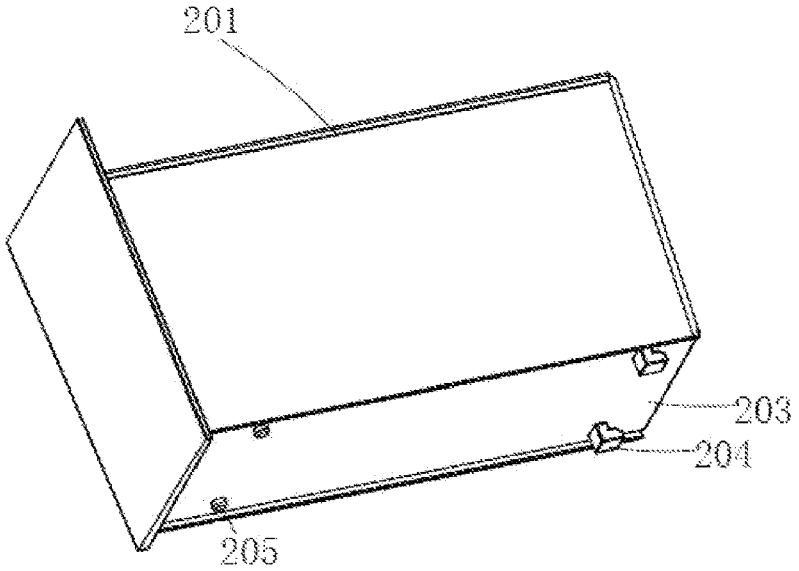
FIG. 6 is a schematic diagram of a box body of the water storage box of FIG. 2.
Figure 7:
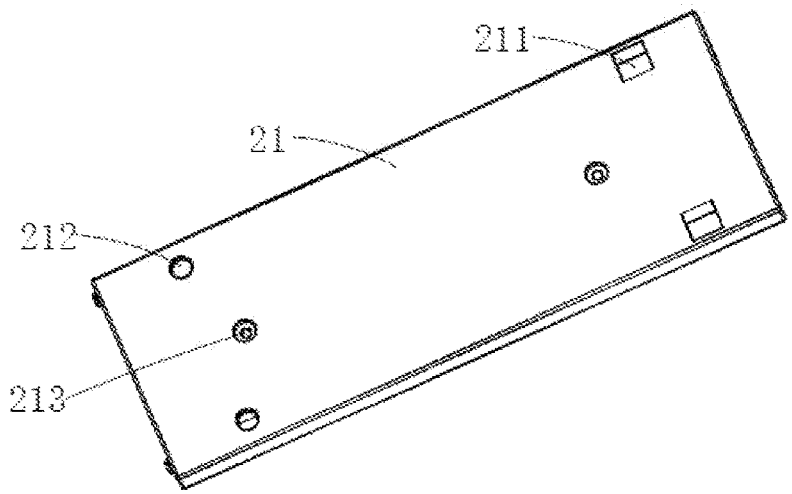
FIG. 7 is a schematic diagram of a mounting base of FIG. 2.

As shown in FIGS. 5 to 7, an engaging portion 204 and a positioning portion 205 protrude from the bottom 203 of the box body 201; the mounting base 21 is provided with an engaging hole 211 and a positioning hole 212, the engaging portion 204 is fitted with the engaging hole 211, and the positioning portion 205 is fitted with the positioning hole 212. During assembly, the engaging portion 204 is engaged with the engaging hole 211, and the box body 201 is rotated downwards with the engaging portion 204 as a fulcrum, such that the positioning portion 205 is embedded into the positioning hole 212. During disassembly, one end of the box body 201 is raised with the engaging portion 204 as a fulcrum, such that the positioning portion 205 is separated from the positioning hole 212, and then, the engaging portion 204 is withdrawn from the engaging hole 211.

The engaging portion 204 is located at a rear end of the bottom 203, and the positioning portion 205 is located at a front end of the bottom 203; correspondingly, the engaging hole 211 is located at a rear end of the mounting base 21, and the positioning hole 212 is located at a front end of the mounting base 21; the structure that the engaging portion and the engaging hole are provided at one end and the positioning portion and the positioning hole are provided at the other end may realize the quick disassembly of the box body 201 and the mounting base 21.

In the present embodiment, the engaging portion 204 is configured as an L-shaped hook, the engaging hole 211 is configured as a rectangular through hole, and the L-shaped hook passes through the rectangular through hole and is attached to a bottom surface of the mounting base 21; the positioning portion 205 is configured as a circular positioning column, and the positioning hole 212 is configured as a circular positioning hole. In other embodiments of the present invention, shapes of the engaging portion, the engaging hole, the positioning portion and the positioning hole are not limited to the above shapes, and fitted shapes may be set according to actual use requirements on a premise that the mounting base is detachably connected with the bottom of the box body.

Since the box body 201 of the water storage box 20 is detachably connected to the mounting base 21, when the water storage box 20 is driven to be ejected from and slide out of the mounting cavity 100 by the pushing-ejecting slide rail 26, the user disassembles the water storage box from the mounting base 21, and may clean the interior of the water storage box 20 or add water into the water storage box 20 in time, thus guaranteeing a water quality of the water storage box 20.

Furthermore, at least one locking hole 213 is provided in the mounting base 21, and a locking bolt passes through the corresponding locking hole 213 to lock the mounting base 21 on the movable rail of the pushing-ejecting slide rail 26. When the pushing-ejecting slide rail 26 is unable to achieve the pushing-ejecting function due to an abnormality, the abnormality may be quickly checked by detaching the locking bolt.

Therefore, the refrigerator with the ice-making water storage box according to the present invention has the following advantages: 1) the water storage box may be automatically ejected and locked by the pushing-ejecting slide rail, such that the water storage box is not required to be provided with a handle, thus reducing space occupation of the water storage box in the refrigerator, and increasing the utilization rate of the internal space of the refrigerator; 2) the sliding guide is provided between the water storage box and the side wall, and when the water storage box slides utilizing the C-shaped pushing-ejecting slide rail at the bottom, the sliding guide facilitates the stable slide of the water storage box and avoids a shake; 3) the sealing gasket is erected at a joint of the upper cover and the box body of the water storage box to achieve a sealing effect of the water storage box; 4) the water storage box is mounted in the refrigerator, and the water purifying device is provided in the water storage box, thus solving problems that due to an external water taking structure of an ice maker of the refrigerator, a placement position of the refrigerator is limited, water pipe reservation is complicated, and the water is prone to pollution.

In another embodiment of the present invention, the present invention further provides another water storage box, a front end surface of which may be turned over, and a problem that a handle type water storage box occupies large space inside a refrigerator may also be solved using the front end surface which may be turned over.

The same reference numerals in FIGS. 8 to 13 as the reference numerals in FIGS. 1 to 7 denote same elements having similar functions, which are not repeated.

Figure 8:
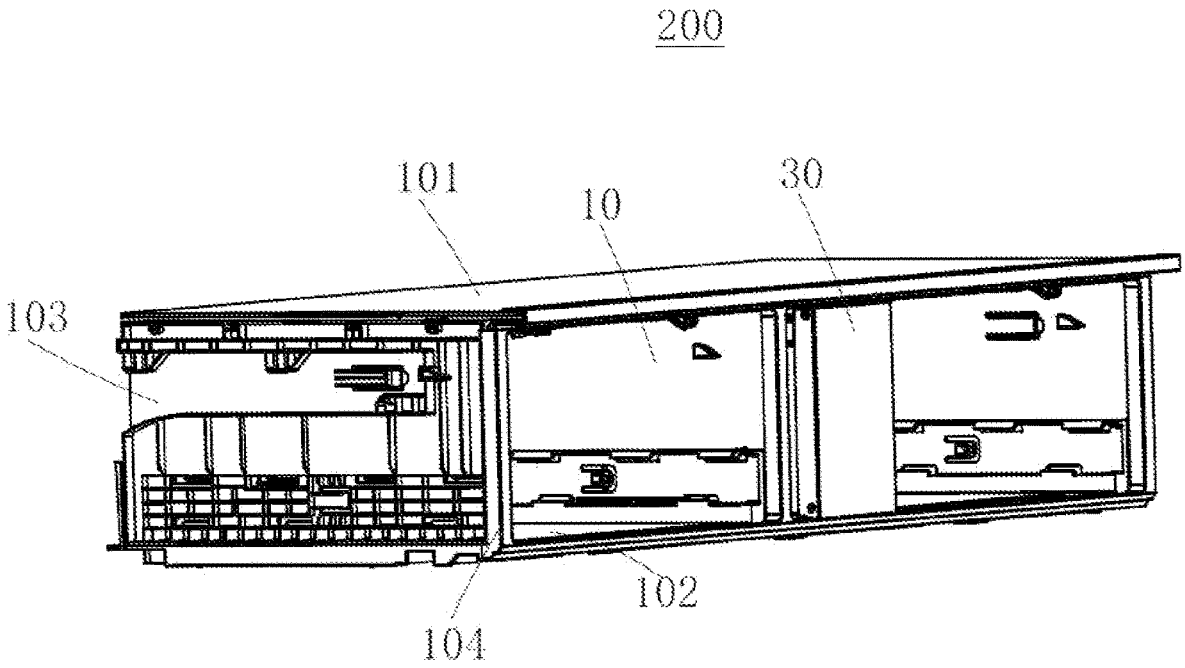
FIG. 8 is a schematic diagram in which a water storage box according to another embodiment of the present invention is mounted in the mounting cavity.
Figure 9:
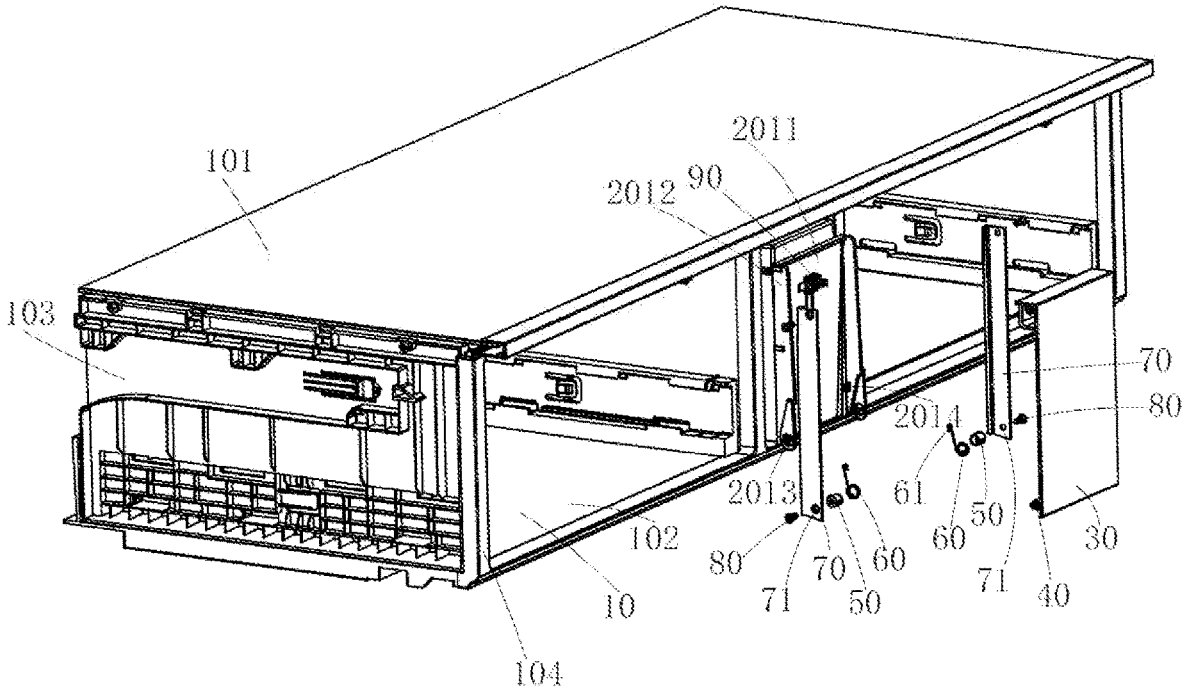
FIG. 9 is a schematic diagram of a handle and a box body of the water storage box in FIG. 8 after disassembled.
Figure 10:
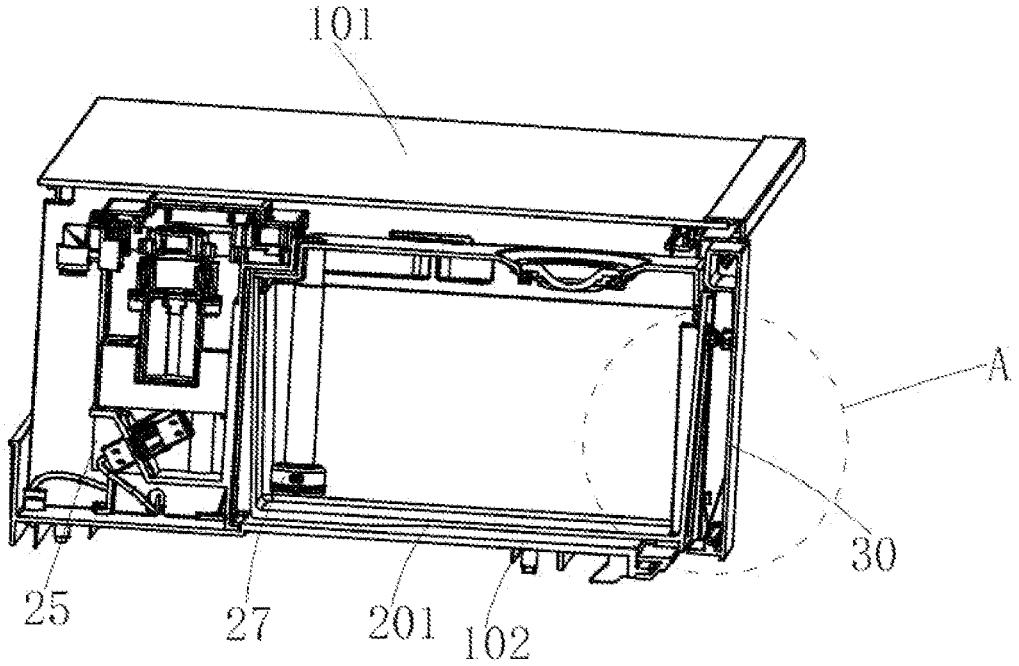
FIG. 10 is a schematic sectional diagram of FIG. 8 from the first perspective.
Figure 11:
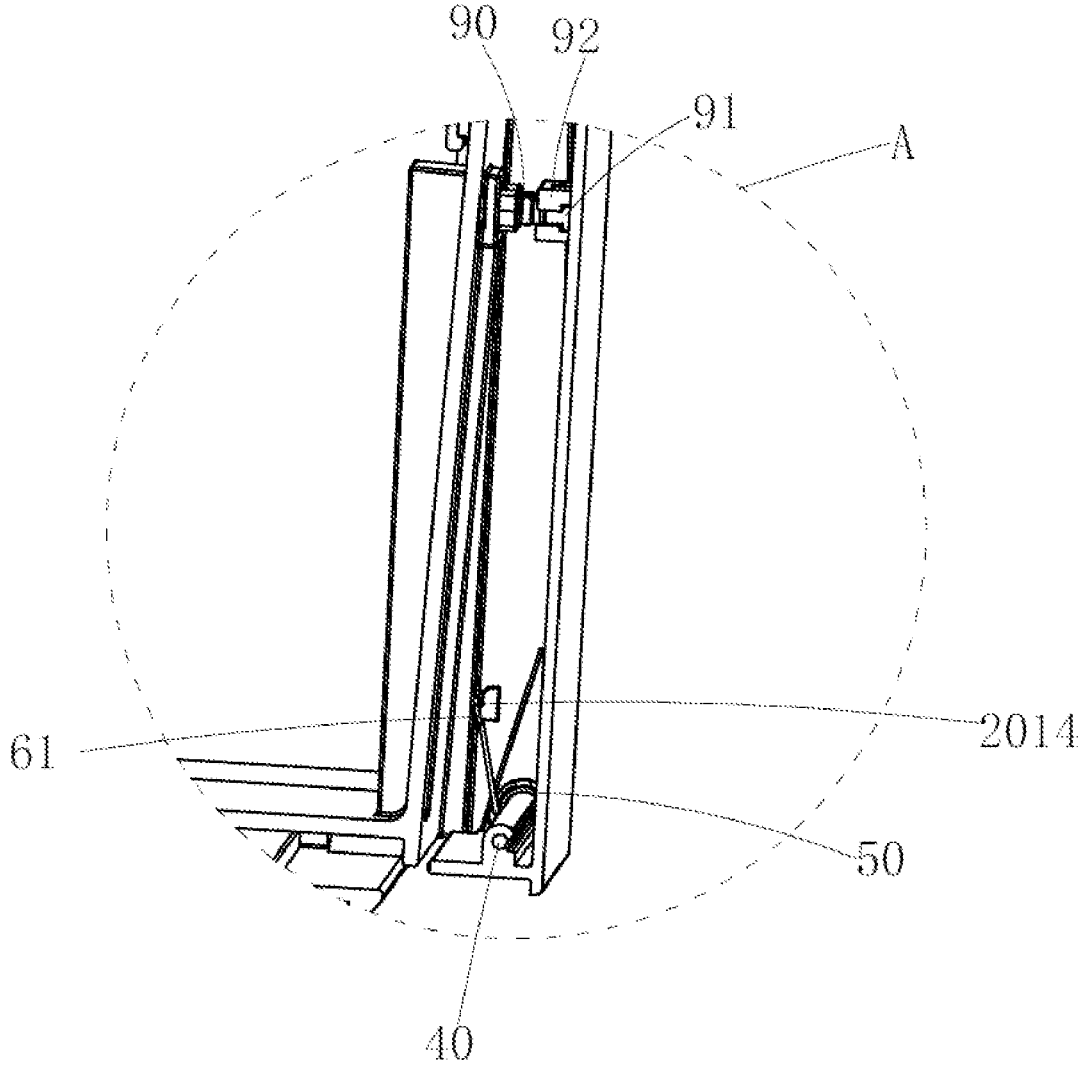
FIG. 11 is a schematic enlarged diagram at broken line A of FIG. 10.

As shown in FIGS. 8 and 9, the water storage box 20 is mounted in a mounting cavity 200, the mounting cavity 200 is provided in a compartment inside a cabinet of the refrigerator, and the water storage box 20 includes a box body and a front panel 30 provided on a front end surface 2011 of the box body. A locking structure and at least one overturning structure are further included between the front end surface 2011 and the front panel 30.

The locking structure includes a locking part 90 and a fitting part 91, the locking part 90 projects from the front end surface 2011 towards the front panel 30, and the fitting part 91 projects from a rear surface of the front panel 30 towards the front end surface 2011; the overturning structure is close to a first side of the front end surface 2011, the at least one locking structure is close to a second side of the front end surface 2011, and the first side is opposite to the second side. In a state where the locking part 90 and the fitting part 91 are separated from each other, the overturning structure drives the fitting part 91 to move away from the locking part 90 or the locking part 90 to move away from the fitting part 91.

In the present embodiment, the locking part 90 is provided on the front end surface 2011, and the fitting part 91 is provided on the rear surface of the front panel 30, but the present invention is not limited thereto. In other embodiments of the present invention, the locking part may be provided on the rear surface of the front panel, and the fitting part may be provided on the front end surface. In other words, the locking part is provided on one of the front end surface and the rear surface of the front panel, the fitting part is provided on the other of the front end surface and the rear surface of the front panel, and the front end surface is opposite to the rear surface of the front panel.

In a preferred embodiment, the locking part 90 is configured as, for example, an elastic jaw, the fitting part 91 is configured as, for example, a hook, the hook extends between a pair of elastic claws of the elastic jaw, and the pair of elastic claws lock the hook; when the front panel 30 where the hook is located is pressed, the hook pushes against the elastic jaw, such that the pair of elastic claws and the hook are separated from each other, and the hook moves away from the elastic jaw under the action of the overturning structure.

Certainly, when the elastic jaw is provided on the rear surface of the front panel 30, after the front panel 30 is pressed, the elastic jaw and the hook are separated from each other, and the elastic jaw moves away from the hook under the action of the overturning structure.

In addition, a connector 92 is further provided between the fitting part 91 and the rear surface of the front panel 30, and the fitting part 91 and the connector 92 are detachably assembled. The fitting part 91 may be replaced in time after an abnormality occurs.

Figure 12:
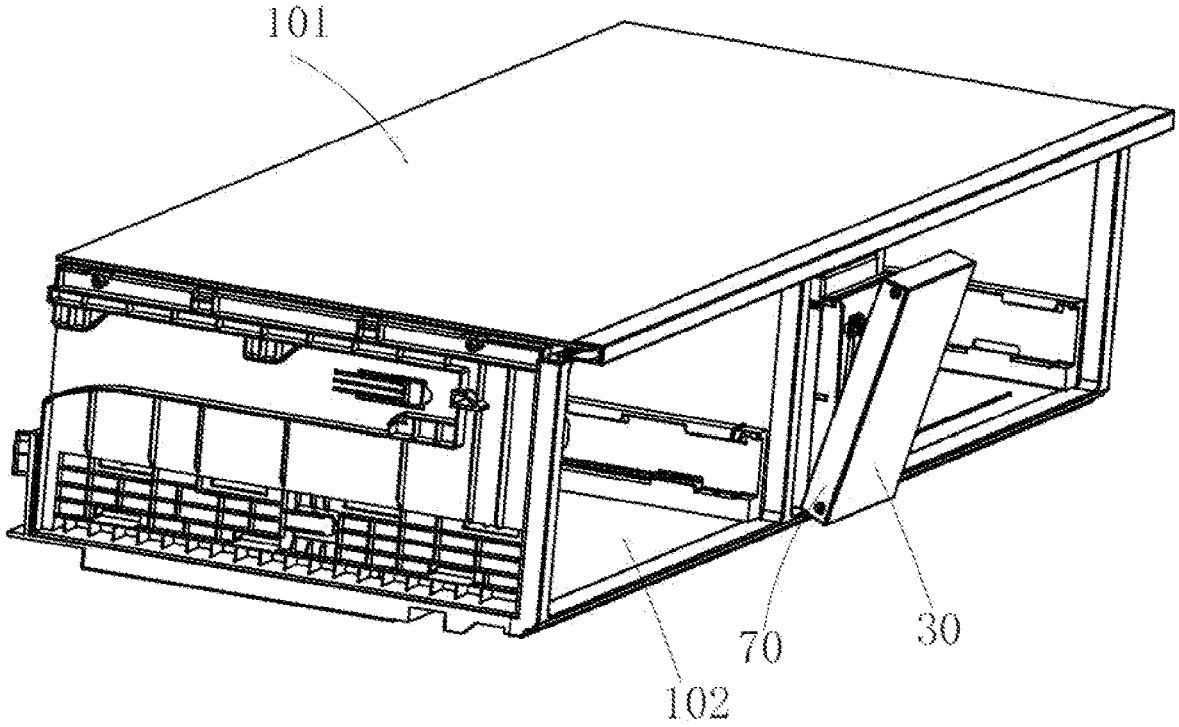
FIG. 12 is a schematic diagram of the water storage box of FIG. 8 with the handle open.
Figure 13:
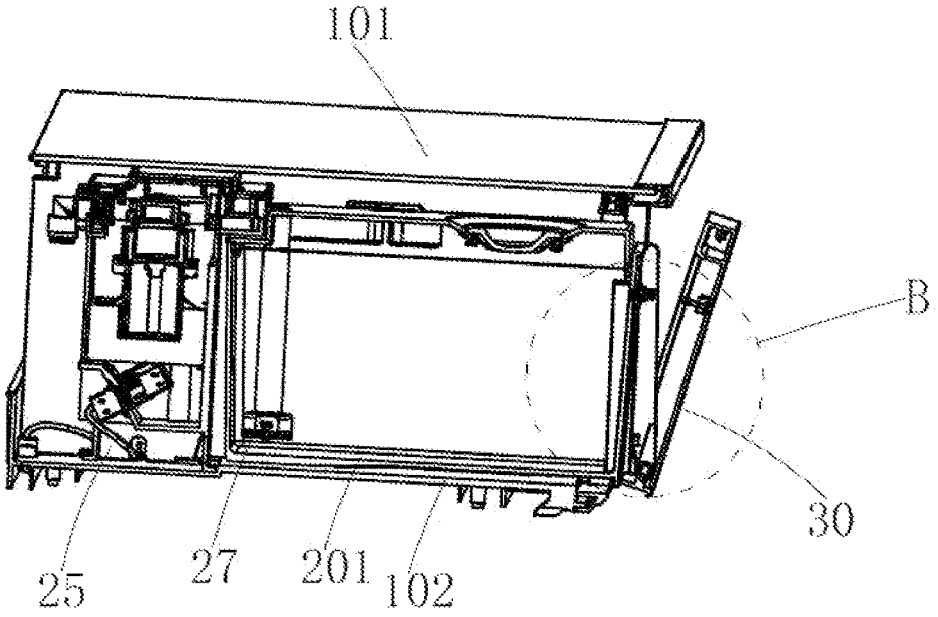
FIG. 13 is a schematic sectional diagram of FIG. 12 from the second perspective.
Figure 14:
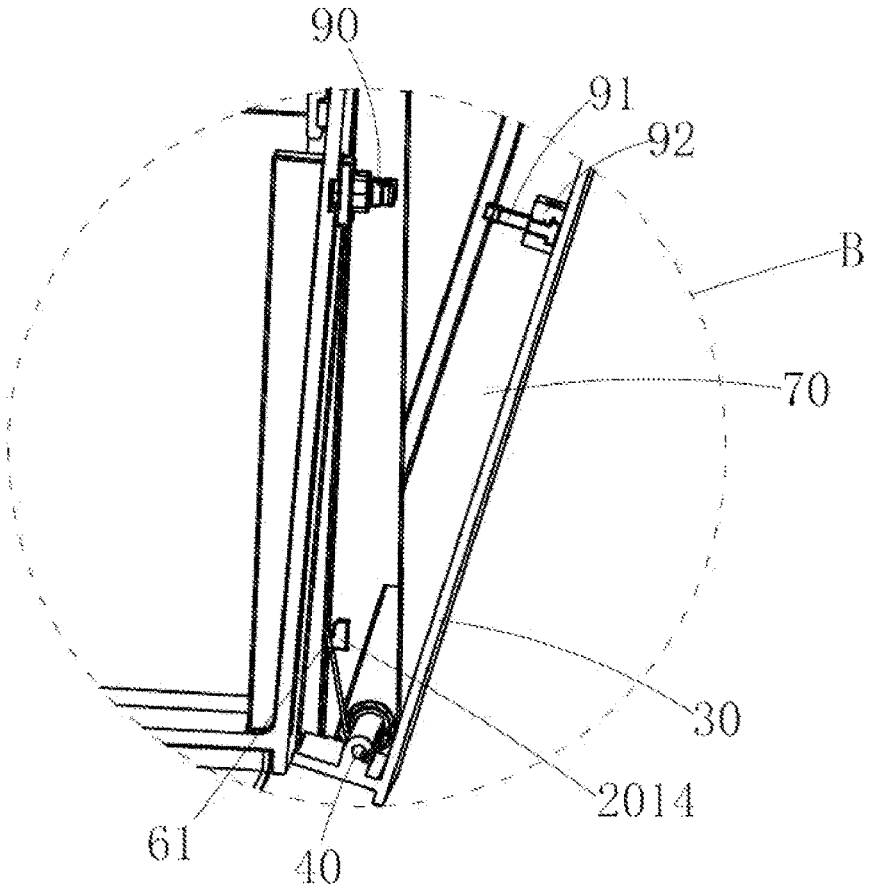
FIG. 14 is a schematic enlarged diagram at broken line B of FIG. 13.

As shown in FIGS. 8 and 12, the front panel 30 is flush with a front end opening of the mounting cavity 100 in an unopened state, and when the front panel 30 is pressed to be turned over, the front panel 30 extends out of the front end opening of the mounting cavity 100. In addition, when the front panel 30 in the overturned state is pressed, the locking part 90 and the fitting part 91 are combined again, and the front panel 30 is attached to the front end surface 2011. The front panel 30 pressed to be turned over may replace the handle of the existing water storage box, and since the front panel 30 is attached to the front end surface 2011 in an unused state, the front panel hardly occupies additional space in the refrigerator, thus solving the problem that the handle type water storage box occupies large space in the refrigerator.

As shown in FIGS. 9 to 14, the at least one overturning structure is provided between the front end surface 2011 and the front panel 30, the overturning structure includes a rotating shaft, a rotating part and an elastic part, and the rotating shaft 40 is provided on the rear surface of the front panel 30; the rotating part 50 includes a rotating shaft hole into which the rotating shaft 40 may be inserted; the rotating part 50 is sleeved with the elastic part 60, a fixed end of the elastic part 60 is incorporated on the rotating part 50, and a free end 61 of the elastic part 60 elastically pushes against the front end surface 2011 of the box body 201. After the locking part 90 and the fitting part 91 are separated from each other, the free end of the elastic part 60 pushes against the front end surface 2011 and provides an elastic force, such that the rotating shaft 40 and the rotating part 50 rotate, and then, the front panel 30 fixed to the rotating shaft 40 rotates away from the front end surface 2011 with the rotating shaft 40 as a fulcrum and is overturned and opened.

The user pulls the water storage box out of the mounting cavity 100 by pulling the overturned front panel 30.

In still another embodiment of the present invention, a pushing-ejecting slide rail (refer to FIGS. 2 and 3 of the present invention) is provided between the bottom of the box body 201 of the water storage box and the lower shelf 102, a first sliding guide and a second sliding guide are provided between the side wall of the box body 201 and the partition 24, the second sliding guide is lapped on the first sliding guide, and the second sliding guide slides back and forth along the first sliding guide, thus solving the unstable slide of the C-shaped pushing-ejecting slide rail provided between the bottom of the box body 201 and the lower shelf 102.

Preferably, the first sliding guide is configured as a first wedge-shaped block, the second sliding guide is configured as a second wedge-shaped block, a second inclined surface of the second wedge-shaped block is lapped on a first inclined surface of the first wedge-shaped block, and the second inclined surface slides on the first inclined surface, which facilitate reduction of a sliding friction force and reducing a sliding resistance of the water storage box.

Furthermore, for detailed descriptions of the pushing-ejecting slide rail, the first sliding guide and the second sliding guide, reference may be made to FIGS. 1 to 7 and the above description of the mounting cavity 100 in the present invention.

In other words, the turnover front panel 30, the locking part 90, the fitting part 91 and the at least one overturning structure in the mounting cavity 200 may be integrated to the front end of the box body 201 of the water storage box 200 in the mounting cavity 100; when the front panel is pressed, the water storage box 20 is pushed and ejected to slide out by the pushing-ejecting slide rail, and meanwhile, the front panel 30 is turned over with respect to the front end surface of the box body 201; at this point, the user grips an upper end of the front panel 30 to drive the water storage box 20 to completely slide out of the mounting cavity 100, and then removes the water storage box 20 from the mounting base.

With continued reference to FIGS. 9 to 14, the front end surface 2011 is provided with a bump 2014, and the free end 61 of the elastic part 60 is sleeved with a depression of the bump 2014, such that the free end 61 hangs against the depression of the bump 2014. The front panel 30 is closed on the front end surface 2011, the free end 61 elastically pushes against the front end surface 2011, and a front wall surface at the depression of the bump 2014 avoids that the free end 61 is separated from the bump 2014 after elastically twisted. At this point, since the locking part 90 and the fitting part 91 are locked to each other, the free end 61 is elastically twisted. When the locking part 90 and the fitting part 91 are separated from each other, the free end 61 is restored to a normal state from the elastic torsion and provides an elastic force to overturn the front panel 30.

In addition, the rotating part 50 is configured as a hollow cylinder, a notch is provided in an annular side wall of the cylinder, and the fixed end of the elastic part 60 is embedded in the notch.

In the present embodiment, the elastic part 60 is configured as, for example, a torsion spring.

With continued reference to FIGS. 9 to 14, a fixing sheet 2012 extends from the front end surface 2011, a through hole 2013 is provided in a lower end of the fixing sheet 2012, and the elastic part 60 and the rotating part 50 are inserted into the through hole 2013.

A decorative strip 70 is provided in a gap between a lateral side of the front end surface 2011 and a lateral side of the front panel 30, a pair of locking holes 71 are provided at opposite ends of the decorative strip 70 respectively, and bolts 80 are inserted into the pair of locking holes 71 to be locked to end portions of the rotating shaft 40 on the rear surface of the front panel 30, such that the decorative strip 70 and the front panel 30 are fixed to each other.

In the present embodiment, an extending direction of the rotating shaft 40 coincides with a width direction of the front panel 30, and a length of the rotating shaft 40 is substantially same as a width of the front panel 30. The rotating shaft 40 is configured as a substantially C-shaped cylinder having an opening opposite to the rear surface of the front panel 30.

The decorative strip 70 is located outside the fixing sheet 2012, and the bolt 80 passes through the locking hole 71 in the lower end of the decorative strip 70, is inserted into the rotating shaft hole of the rotating part 50 at the lower end of the fixing sheet 2012, passes through the rotating shaft hole, and is locked to one end of the rotating shaft 40.

The elastic force provided by the free end 61 of the elastic part 60 causes the rotating part 50 and the rotating shaft 40 on the rear surface of the front panel 30 to rotate together in the through hole 2013 in the lower end of the fixing sheet 2012, and then, the front panel 30 and the decorative strip 70 are turned over together. After the front panel 30 and the decorative strip 70 are turned over together, the user pulls the water storage box 200 out of the mounting cavity 200 by griping the upper end of the front panel 30, and the upper end of the front panel 30 is adjacent to the upper shelf 101.

In the present embodiment, the rotating part 50, the elastic part 60, the decorative strip 70 and the fixing sheet 2012 are symmetrically provided at two opposite end portions of the rotating shaft 40 respectively.

Figure 15:
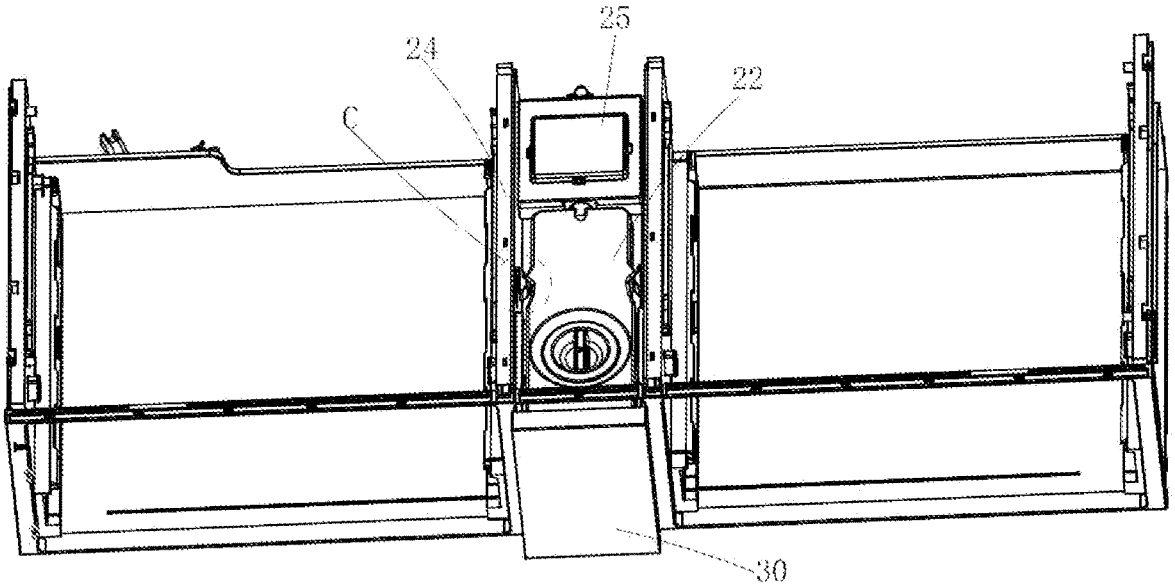
FIG. 15 is a schematic diagram of the mounting cavity of FIG. 8 with an upper shelf removed.
Figure 16:
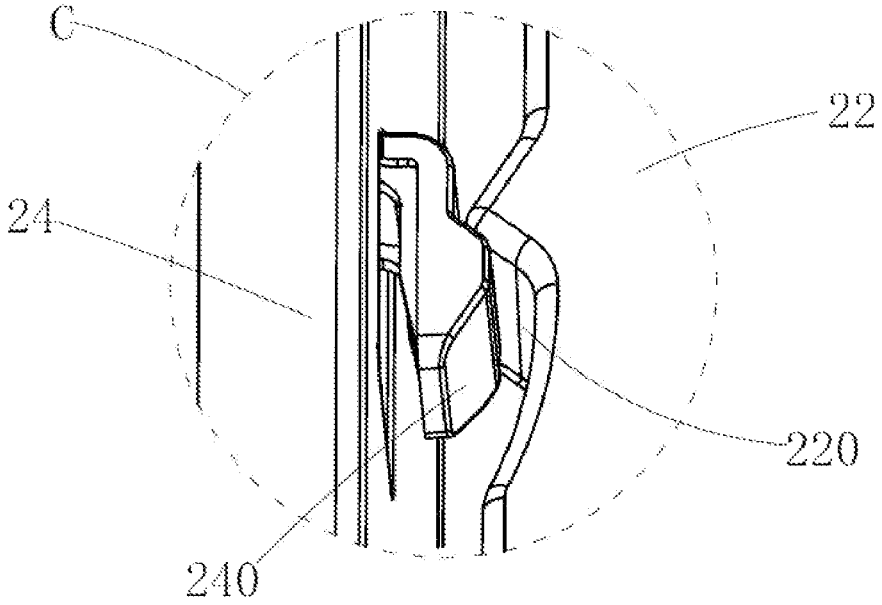
FIG. 16 is a schematic enlarged diagram at broken line C of FIG. 15.

Elements in FIGS. 15 and 16 with same reference numerals as in FIGS. 1 to 7 have similar functions, and are not repeated.

When the user presses the front panel 30 to turn over the front panel 30 relative to the front end surface of the box body 201, in order to prevent the water storage box from sliding in the mounting cavity 100 under stress, a cantilever portion 240 protrudes from the partition 24 in the mounting cavity 200 towards the inner side of the water storage box; corresponding to the cantilever portion 240, the water storage box is provided with a groove 220, and the cantilever portion 240 is accommodated in the groove 220. When the user applies a force to the front panel 30 on the front end surface of the box body of the water storage box, the water storage box is stressed to form a tendency of sliding into the mounting cavity 200; since the rear end of the water storage box is adjacent to the water pump assembly 25, the water pump assembly 25 applies a reverse force to the rear end of the water storage box, such that the water storage box tends to slide out of the mounting cavity 200; the accommodation of the cantilever portion 240 in the groove 220 may prevent the tendency that the water storage box slides out of the mounting cavity 200, so as to limit the water storage box.

In the present embodiment, one end of the cantilever portion 240 is fixedly connected with the inner side of the partition 240, and the other end of the cantilever portion 240 is not connected with the partition 240; when the water storage box is required to be pulled out of the mounting cavity, the user applies a large pulling force, such that a groove wall of the groove 220 in the water storage box may press the end portion of the cantilever portion 240 which is not connected to the partition 240, the cantilever portion 240 moves towards the inner side of the partition 24, the groove 220 passes over the cantilever portion 240, and then, the water storage box is pulled out of the mounting cavity 200.

In the present embodiment, the groove 220 is provided in the lateral side of the upper cover 22 of the water storage box. The left and right lateral sides of the upper cover 22 are provided with the grooves 220 respectively, and corresponding cantilever structures are provided on the inner sides of the partitions 24 provided on the left and right sides of the water storage box respectively.

The present invention further provides a refrigerator, the refrigerator is provided therein with a mounting cavity 200, and a turnover front panel 30 is provided on a front end surface 2011 of a box body 201 of a water storage box assembled in the mounting cavity 200; the front panel 30 is overturned away from the front end surface 2011 in a use state, such that a user may grasp the front panel conveniently and pull the water storage box out of the mounting cavity 200; the front panel 30 is closed on the front end surface 2011 in an unused state, thus reducing space occupation of the water storage box in the refrigerator, and increasing a utilization rate of space in the refrigerator.

Therefore, in the water storage box according to the other embodiment of the present invention, the front end surface of the box body of the water storage box is provided with the front panel which may be turned over, and the front panel is pressed to be turned over, such that the user may grasp the front panel conveniently, and the handle of the existing handle type water storage box is replaced, thus solving the problem that the handle type water storage box occupies large space in the refrigerator.

In summary, in the present invention, the problem that the existing handle type water storage box occupies large space in the refrigerator may be solved by the pushing-ejecting slide rail, the turnover front panel or a combination of the pushing-ejecting slide rail and the turnover front panel.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments may be combined properly to form other embodiments which may be understood by those skilled in the art.

A series of the detailed descriptions set forth above is merely specific description of feasible embodiments of the present invention, and is not intended to limit the protection scope of the present invention. Equivalent embodiments or modifications made within the spirit of the present invention shall fall within the protection scope of the present invention.

What is claimed is:

1. A water storage box, comprising a box body and a front panel provided on a front end surface of the box body, and further comprising:

a locking structure comprising a locking part and a fitting part, one of the locking part and the fitting part being provided on a rear surface of the front panel, the other of the locking part and the fitting part being provided on the front end surface, and the locking structure being provided near a first side of the front end surface; and at least one overturning structure provided between the rear surface and the front end surface, the at least one overturning structure being provided close to a second side of the front end surface, and the first side being opposite to the second side;

wherein in a state where the locking part and the fitting part are separated, the overturning structure drives the locking part to move away from the fitting part, or the overturning structure drives the fitting part to move away from the locking part;

wherein the water storage box is provided in a mounting cavity in the compartment of the refrigerator, the front panel is flush with a front end opening of the mounting cavity, and the front panel extends out of the front end opening after turned over;

wherein a pushing-ejecting slide rail is provided between a bottom of the box body and a lower shelf of the mounting cavity; a partition is provided in the mounting cavity, the partition is adjacent to a side wall of the box body of the water storage box, a first sliding guide is provided on the partition, a second sliding guide is provided on the side wall, the second sliding guide is lapped on the first sliding guide, and the second sliding guide may slide along the first sliding guide;

wherein the first sliding guide is configured as a first wedge-shaped block protruding from the partition, and the second sliding guide is configured as a second wedge-shaped block protruding from the side wall; an inclined surface of the second wedge-shaped block is lapped on an inclined surface of the first wedge-shaped block, and the inclined surface of the second wedge-shaped block may slide in a front-back direction of the first sliding guide along the inclined surface of the first wedge-shaped block.

2. The water storage box according to claim 1, wherein the locking part and the fitting part have structures locked and unlocked by a pressing operation.

3. The water storage box according to claim 1, wherein the overturning structure comprises a rotating shaft, a rotating part and an elastic part, and the rotating shaft is provided on the rear surface; the rotating part comprises a rotating shaft hole, and the rotating shaft is accommodated in the rotating shaft hole; the rotating part is sleeved with the elastic part, a fixed end of the elastic part is incorporated in the rotating part, and a free end of the elastic part elastically pushes against the front end surface.

4. The water storage box according to claim 3, wherein a bump is provided on the front end surface, the free end is sleeved with a depression of the bump, and the free end may elastically push against the front end surface; a notch is provided in the rotating part, and the fixed end of the elastic part is fixed in the notch.

5. The water storage box according to claim 3, wherein a fixing sheet extends from the front end surface, a through hole is provided in the fixing sheet, and the elastic part and the rotating part are inserted into the through hole; a decorative strip is provided in a gap between the front end surface and the front panel, a locking hole is provided in the decorative strip, a screw penetrates through the locking hole and is locked in the rotating shaft hole, and then, the decorative strip, the rotating part and the front panel are fixedly connected with one another.

6. The water storage box according to claim 1, wherein a partition is provided in the mounting cavity in the compartment of the refrigerator, and a cantilever portion protrudes from an inner side of the partition; a groove is provided in a lateral side of an upper cover of the water storage box; the cantilever portion is snapped into the groove.

7. A refrigerator, in which the water storage box according to claim 1 is mounted.

8. A water storage box, comprising a box body and a front panel provided on a front end surface of the box body, and further comprising:

a locking structure comprising a locking part and a fitting part, one of the locking part and the fitting part being provided on a rear surface of the front panel, the other of the locking part and the fitting part being provided on the front end surface, and the locking structure being provided near a first side of the front end surface; and at least one overturning structure provided between the rear surface and the front end surface, the at least one overturning structure being provided close to a second side of the front end surface, and the first side being opposite to the second side;

wherein in a state where the locking part and the fitting part are separated, the overturning structure drives the locking part to move away from the fitting part, or the overturning structure drives the fitting part to move away from the locking part;

wherein the overturning structure comprises a rotating shaft, a rotating part and an elastic part, and the rotating shaft is provided on the rear surface; the rotating part comprises a rotating shaft hole, and the rotating shaft is accommodated in the rotating shaft hole; the rotating part is sleeved with the elastic part, a fixed end of the elastic part is incorporated in the rotating part, and a free end of the elastic part elastically pushes against the front end surface.

9. The water storage box according to claim 8, wherein a bump is provided on the front end surface, the free end is sleeved with a depression of the bump, and the free end may elastically push against the front end surface; a notch is provided in the rotating part, and the fixed end of the elastic part is fixed in the notch.

10. The water storage box according to claim 8, wherein a fixing sheet extends from the front end surface, a through hole is provided in the fixing sheet, and the elastic part and the rotating part are inserted into the through hole; a decorative strip is provided in a gap between the front end surface and the front panel, a locking hole is provided in the decorative strip, a screw penetrates through the locking hole and is locked in the rotating shaft hole, and then, the decorative strip, the rotating part and the front panel are fixedly connected with one another.

11. The water storage box according to claim 8, wherein the locking part and the fitting part have structures locked and unlocked by a pressing operation.

12. The water storage box according to claim 8, wherein the water storage box is provided in a mounting cavity in the compartment of the refrigerator, the front panel is flush with a front end opening of the mounting cavity, and the front panel extends out of the front end opening after turned over.

13. The water storage box according to claim 12, wherein a partition is provided in the mounting cavity in the compartment of the refrigerator, and a cantilever portion protrudes from an inner side of the partition; a groove is provided in a lateral side of an upper cover of the water storage box; the cantilever portion is snapped into the groove.

14. The water storage box according to claim 12, wherein a pushing-ejecting slide rail is provided between a bottom of the box body and a lower shelf of the mounting cavity; a partition is provided in the mounting cavity, the partition is adjacent to a side wall of the box body of the water storage box, a first sliding guide is provided on the partition, a second sliding guide is provided on the side wall, the second sliding guide is lapped on the first sliding guide, and the second sliding guide may slide along the first sliding guide.

* * * * *